US005083966A

United States Patent [19]

Blank

[11] Patent Number: 5,083,966

[45] Date of Patent: Jan. 28, 1992

[54] POSEABLE SOFT DOLL

[75] Inventor: Peter G. Blank, Wayzata, Minn.

[73] Assignee: Imagination Factory, Ltd., New Hope, Minn.

[21] Appl. No.: 647,045

[22] Filed: Jan. 29, 1991

[51] Int. Cl.[5] ..... A63H 9/00

[52] U.S. Cl. ..... 446/369; 446/371

[58] Field of Search ..... 446/324, 327, 369, 370, 446/371, 376, 382, 391, 487

[56] References Cited

U.S. PATENT DOCUMENTS

| | | | |
|---|---|---|---|
| 1,651,738 | 12/1927 | Stein et al. | 446/327 X |
| 1,701,219 | 2/1929 | Teason | 446/324 |
| 2,540,701 | 2/1951 | Thorpe | 446/369 |
| 3,789,547 | 2/1974 | Chemarin . | |
| 3,818,631 | 6/1974 | Cederholm . | |
| 3,882,633 | 5/1975 | Goldfarb et al. . | |
| 3,955,309 | 5/1976 | Noble . | |
| 4,136,484 | 1/1979 | Abrams . | |
| 4,208,832 | 6/1980 | Corriveau . | |
| 4,601,670 | 7/1986 | Williams | 446/327 |
| 4,662,857 | 5/1987 | Quinn et al. | 446/371 |
| 4,758,200 | 7/1988 | Von Moltke . | |
| 4,878,871 | 11/1989 | Noto | 446/901 X |
| 4,884,991 | 12/1989 | Terzian | 446/369 |
| 4,952,191 | 8/1990 | Martinez | 446/324 |

FOREIGN PATENT DOCUMENTS

| | | | |
|---|---|---|---|
| 523241 | 4/1931 | Fed. Rep. of Germany | 446/371 |
| 2346675 | 3/1975 | Fed. Rep. of Germany | 446/371 |

*Primary Examiner*—Robert A. Hafer
*Assistant Examiner*—Sam Rimell
*Attorney, Agent, or Firm*—Kinney & Lange

[57] ABSTRACT

A poseable, soft doll has a head which is constructed of a generally circular front portion and a generally circular back portion which are sewn together. The head is attached to an inner body by a flat tubular neck which is attached at its upper end to the back portion of the head along a first connection line which is generally parallel to and above a horizontal center line of the back portion. At its lower end, the neck is attached to an upper end of the inner body along a second connection line. A shirt covers the inner body and a portion of the neck. Arms are attached to the shirt, as is a bottom panel with legs attached.

13 Claims, 11 Drawing Sheets

Fig. 11E
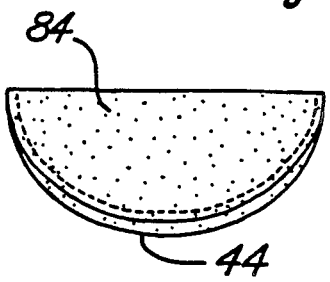
Fig. 11F
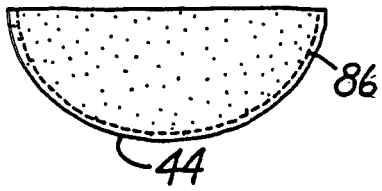
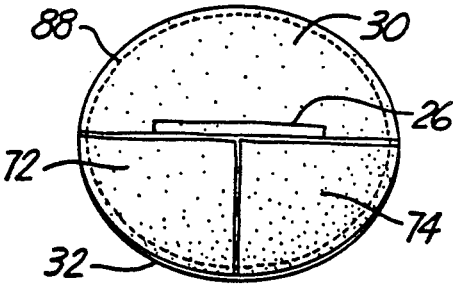
Fig. 11G
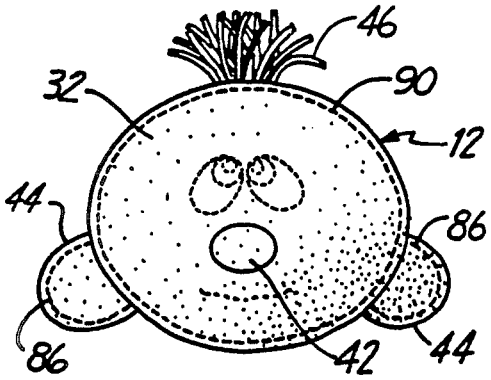
Fig. 11H
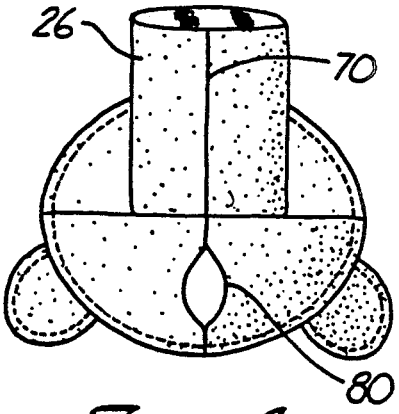
Fig. 11I
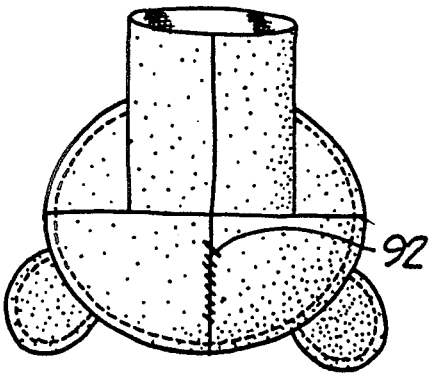
Fig. 11J

POSEABLE SOFT DOLL

BACKGROUND OF THE INVENTION

The present invention relates to dolls. More particularly, the invention relates to poseable soft dolls having a head and neck arrangement which permits the doll to assume a large number of different poses.

One of the oldest and most enduring forms of toys are dolls. They have been around, in various forms, for centuries and have been made of a wide variety of different materials.

Dolls which are capable of assuming different poses are very popular. Poseable dolls made of hard materials, soft materials, and combinations of hard and soft materials have been made and proposed for many years. For a poseable doll, the connection of the head and the limbs to the body must be such that the doll or stuffed animal can assume more than one pose. Examples of dolls and the connection of head or limbs to the body are found in the following U.S. Pat. Nos.: 3,789,547, 3,818,631, 3,882,633, 3,955,309, 4,136,484, 4,208,832, 4,662,857, 4,758,200, and 4,884,991.

There is a continuing need and demand for new and different dolls which are capable of assuming many different poses.

SUMMARY OF THE INVENTION

The poseable soft doll of the present invention has a head which is attached to the body by a flat tubular neck. The neck is attached at its upper end to the back portion of the head along a first connection line which is generally parallel to and above the horizontal center line of the back portion of the head. At its lower end, the neck is attached to the upper end of the body along a second connection line which is generally parallel to the first connection line.

In a preferred embodiment of the present invention, the body to which the neck is attached is a stuffed fabric inner body. A sweat shirt or other shirt covers the inner body and forms part of an outer body. Tubular fabric arms are sewn into the shirt and have stuffed hands which extend out the sleeves of the shirt.

At the bottom end of the shirt, fabric legs and a bottom panel are attached. The attachment is done by sewing of the bottom panel to the lower end of the shirt.

The unique head/neck/body attachment allows the head to pivot about the first and second connection lines. The locatons of these connection lines maintain the proper orientation of the head with respect to the body, while allowing the body to take a variety of different positions.

BRIEF DESCRIPTION OF THE DRAWINGS

FIGS. 11A–11M show the steps performed in fabricating the neck, head, and inner body of the doll.

DETAILED DESCRIPTION OF THE PREFERRED EMBODIMENTS

Figure 1:
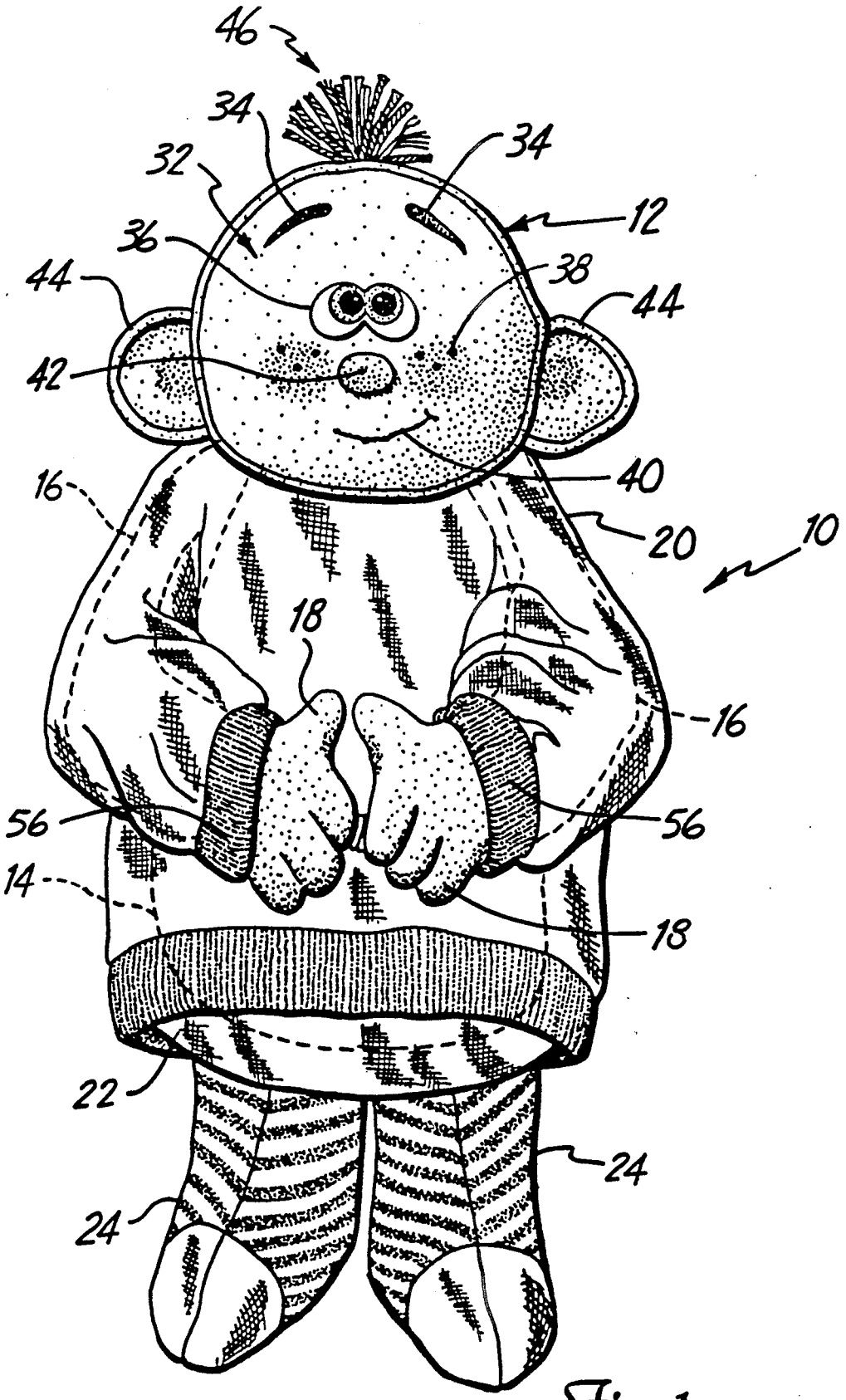
FIG. 1 shows a front view of a preferred embodiment of the doll of the present invention.

Doll 10 shown in FIG. 1 is a soft, stuffed doll having a head 12, inner body 14 (shown in phantom), a pair of arms 16, a pair of hands 18, outer shirt 20, bottom panel 22, and a pair of legs 24.

Head 12 is connected to inner body 14 by a flat tubular neck 26 (shown in FIGS. 2–5 and FIGS. 11A–11M). At its upper end, neck 26 is attached along a first horizontal connection line 28 to back 30 of head 12. At its lower end, neck 28 is connected to the upper end of inner body 14 along second horizontal connection line 29.

Front face 32 of head 12 has eyebrows 34, eyes 36, freckles 38, and mouth 40 which are formed by embroidery. Nose 42 is preferably a plastic button which is covered with fabric and attached to front face 32 by a washer (not shown). Ears 44 and hair 46 are attached to head 12 by sewing.

Figure 2:
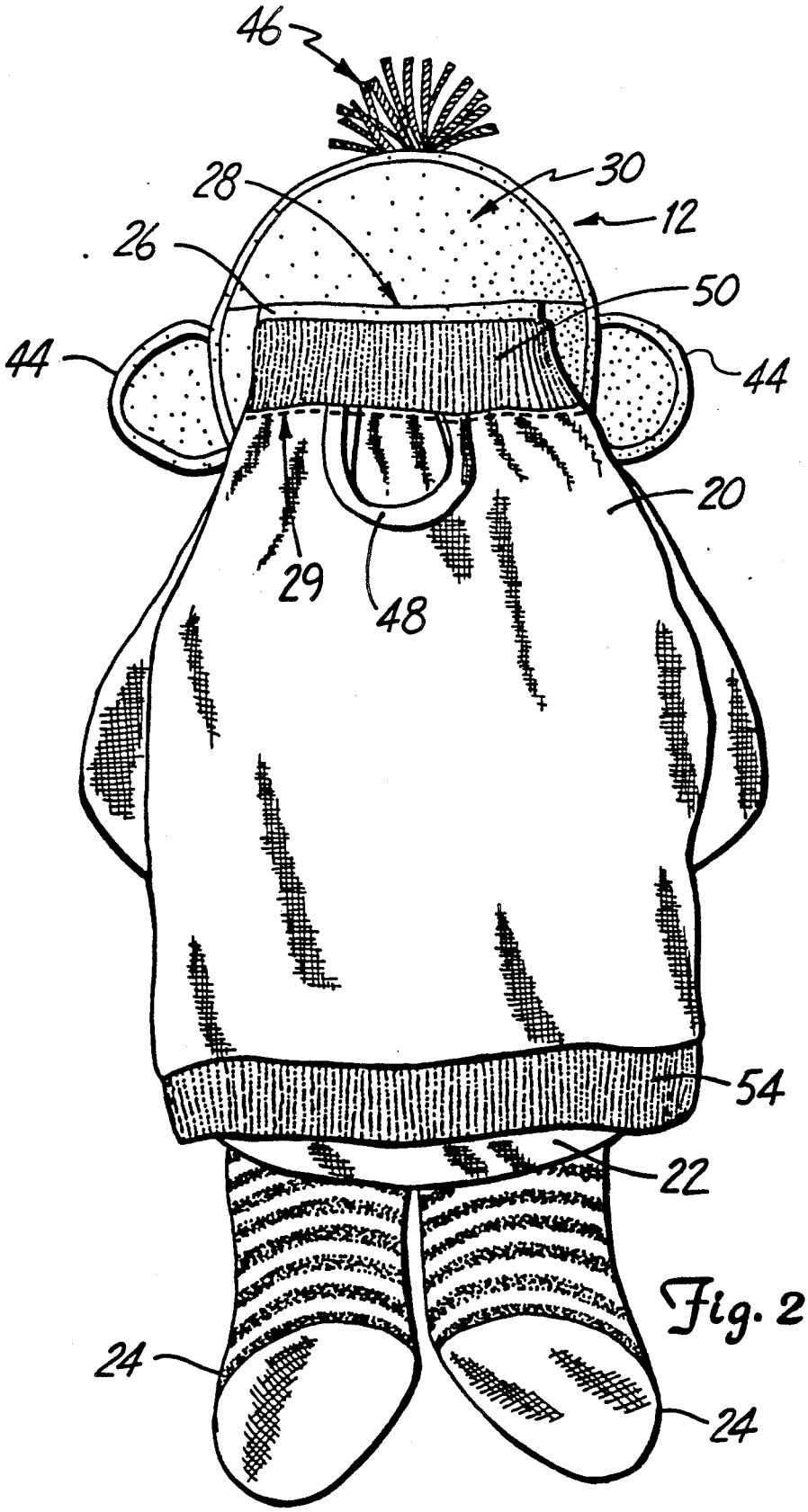
FIG. 2 shows a back view of the doll.
Figure 3:
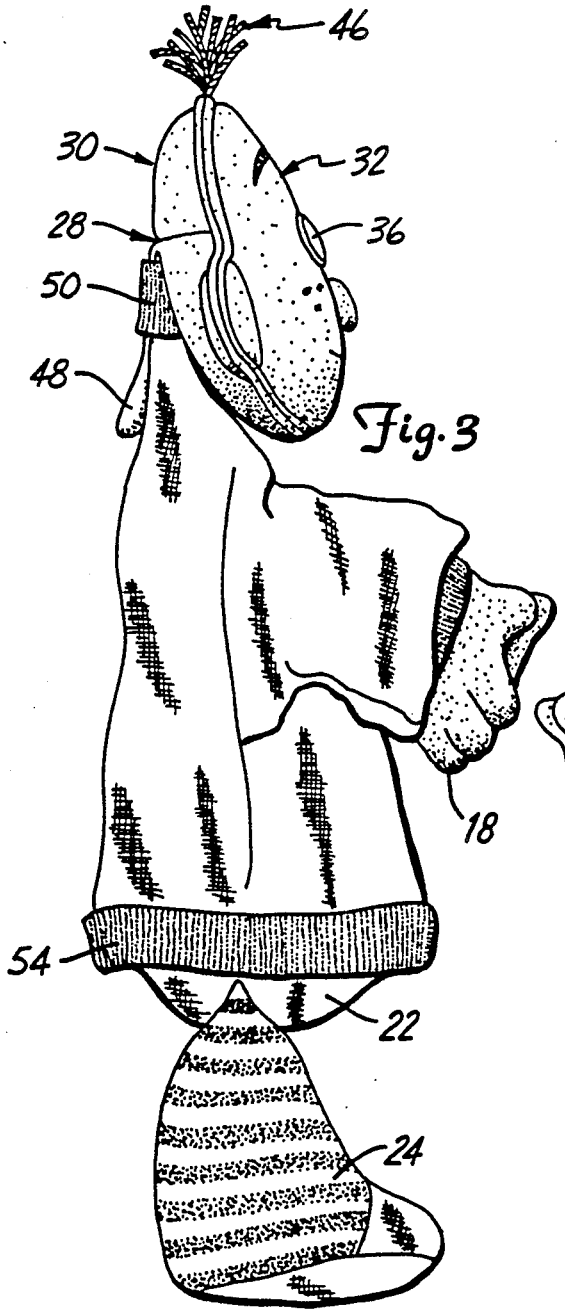
FIGS. 3 and 4 show side views of the doll.
Figure 4:
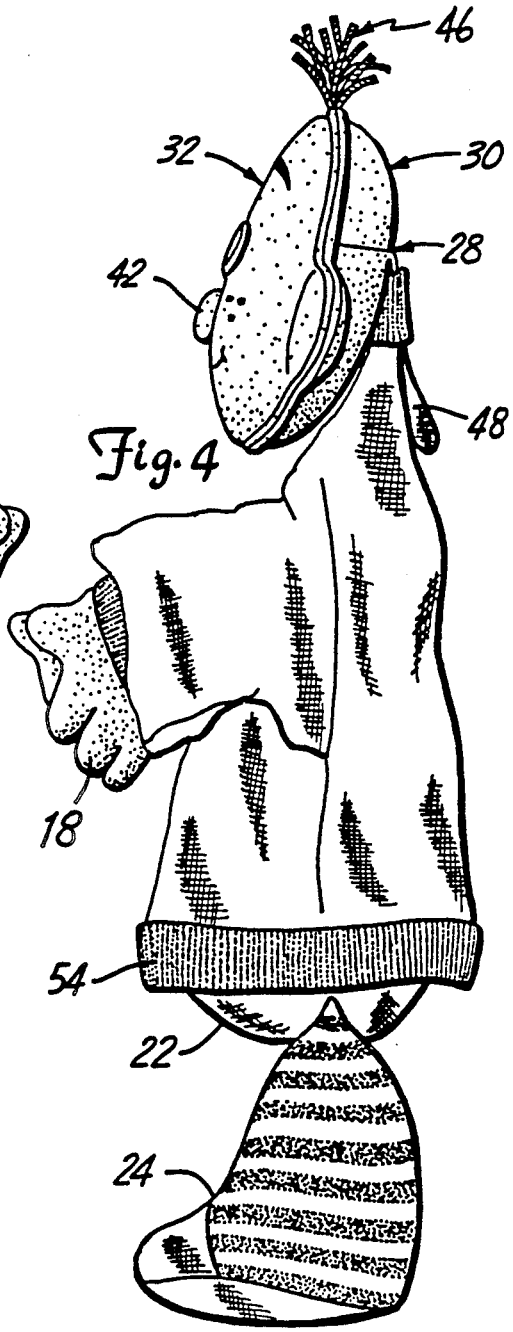
Figure 5:
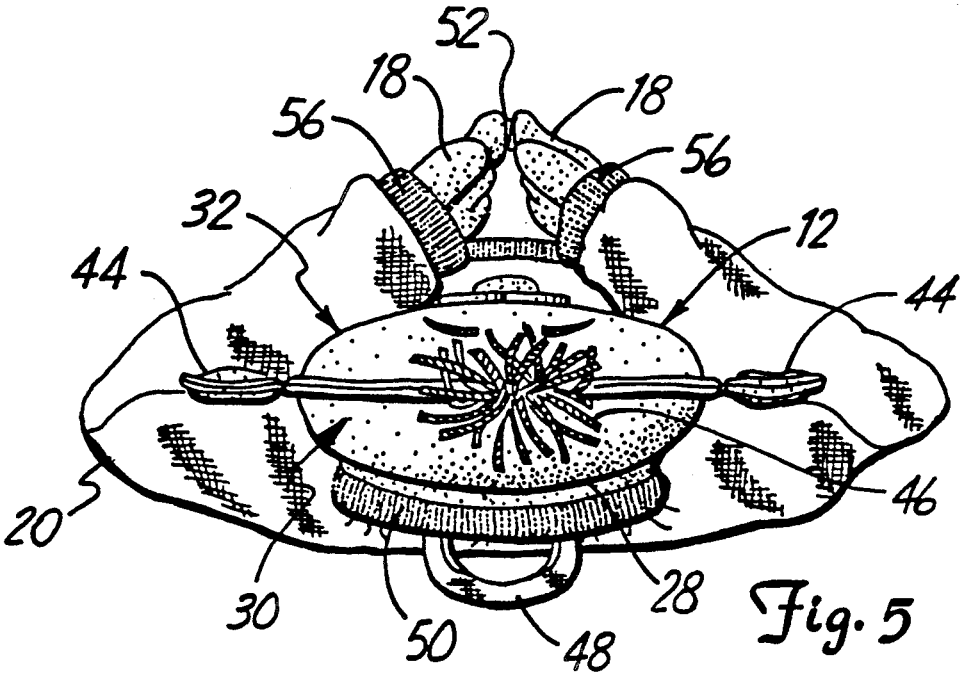
FIG. 5 shows a top view of the doll.
Figure 6:
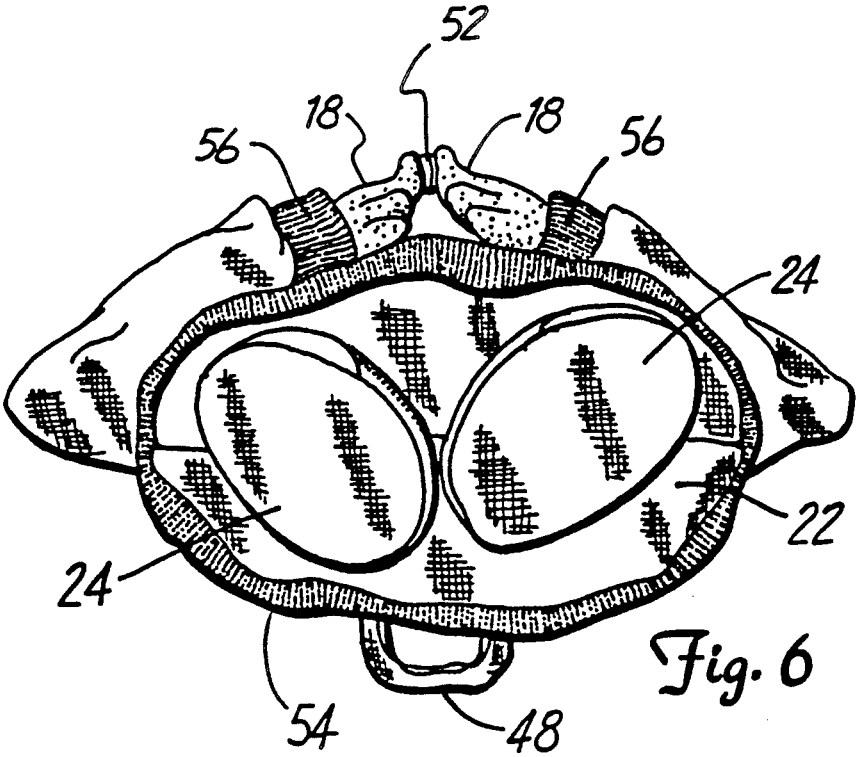
FIG. 6 shows a bottom view of the doll.

As illustrated in FIG. 2, loop 48 is attached to the back side of shirt 20 near collar 50. Loop 48 provides a convenient means for carrying doll 10, and is also helpful when posing the doll.

Figure 7:
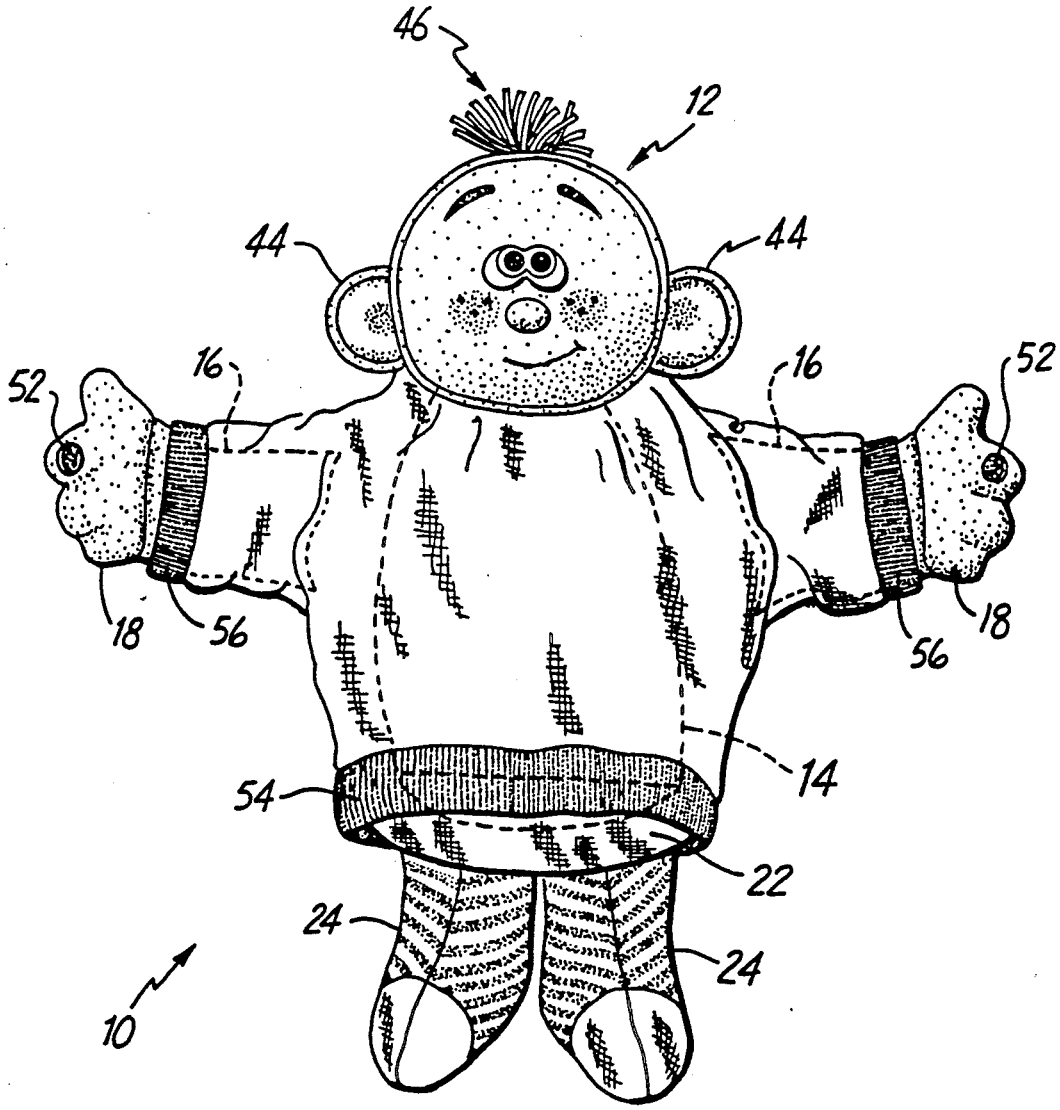
FIG. 7 shows a front view of the doll, with the arms spread apart.

On the inner surfaces of fingers 18 are hook/loop fasteners 52. Fasteners 52 engage one another to hold the hands together as shown in the pose illustrated in FIGS. 1–6. Hands 18 can be separated, however, as shown in FIG. 7. In addition, fasteners 52 can engage various parts of doll 10 so that arms 16 and hands 18 can be posed in various positions.

In the preferred embodiment of the present invention, front face 32, head back 30, neck 26, ears 44, arms 16, and hands 18 are made of a tricot/velour fabric. Inner body 14 is a woven cotton/polyester fabric. Nose 42 is plastic, covered with tricot/velour and attached to front face 32 by a washer. Hair 46 is made of yarn. Outer body shirt 20 is a 100% polyester fleece sweat shirt knit with a knit collar 50, knit waist band 54, and knit cuffs 56. Legs 24 and bottom panel 22 are made of a 100% polyester fleece material. Eyebrows 34, eyes 36, freckles 38, and mouth 40 are formed by embroidery. Stuffing for head 12, inner body 14, hands 18 and legs 24 is a 100% polyester fiber fill.

Figure 8:
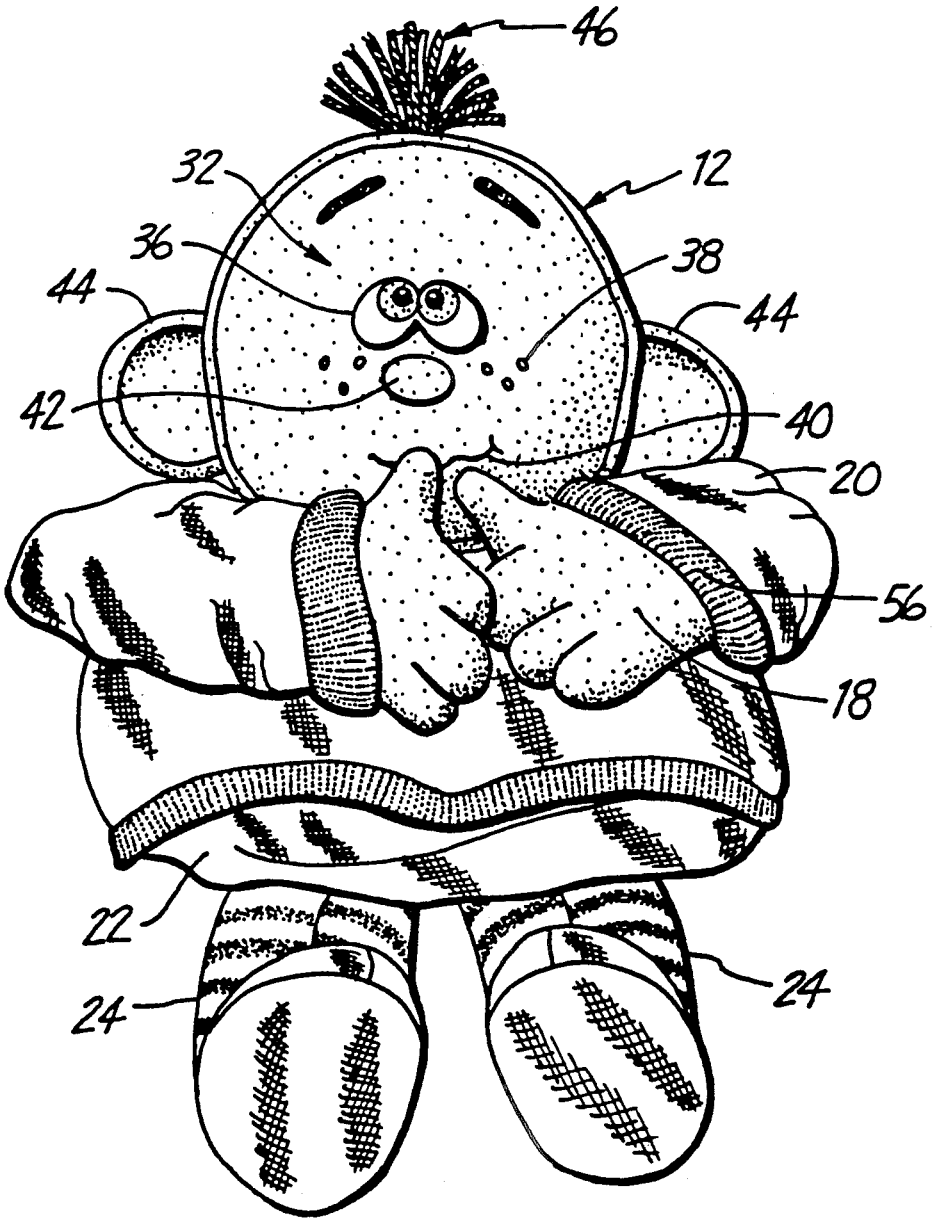
FIG. 8 shows the doll in a sitting position.
Figure 9:
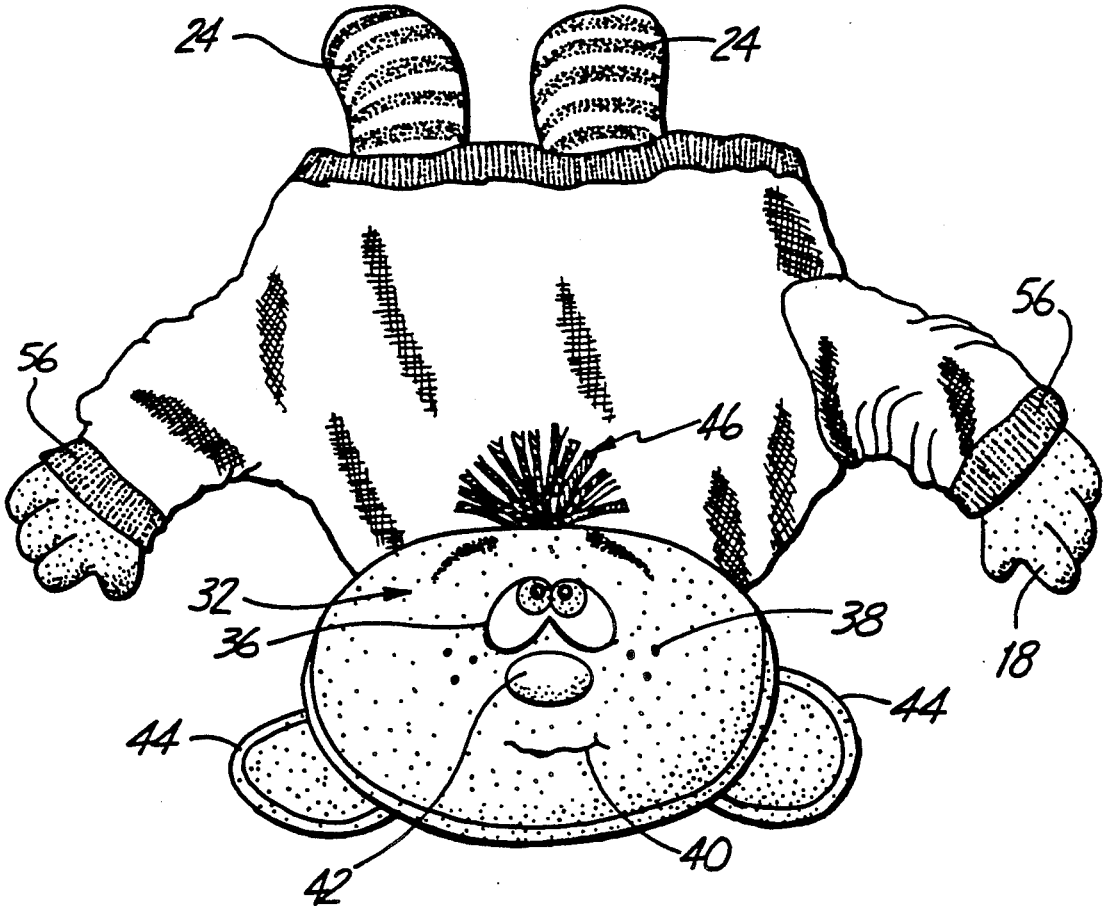
FIG. 9 shows the doll in a reclining position.
Figure 10:
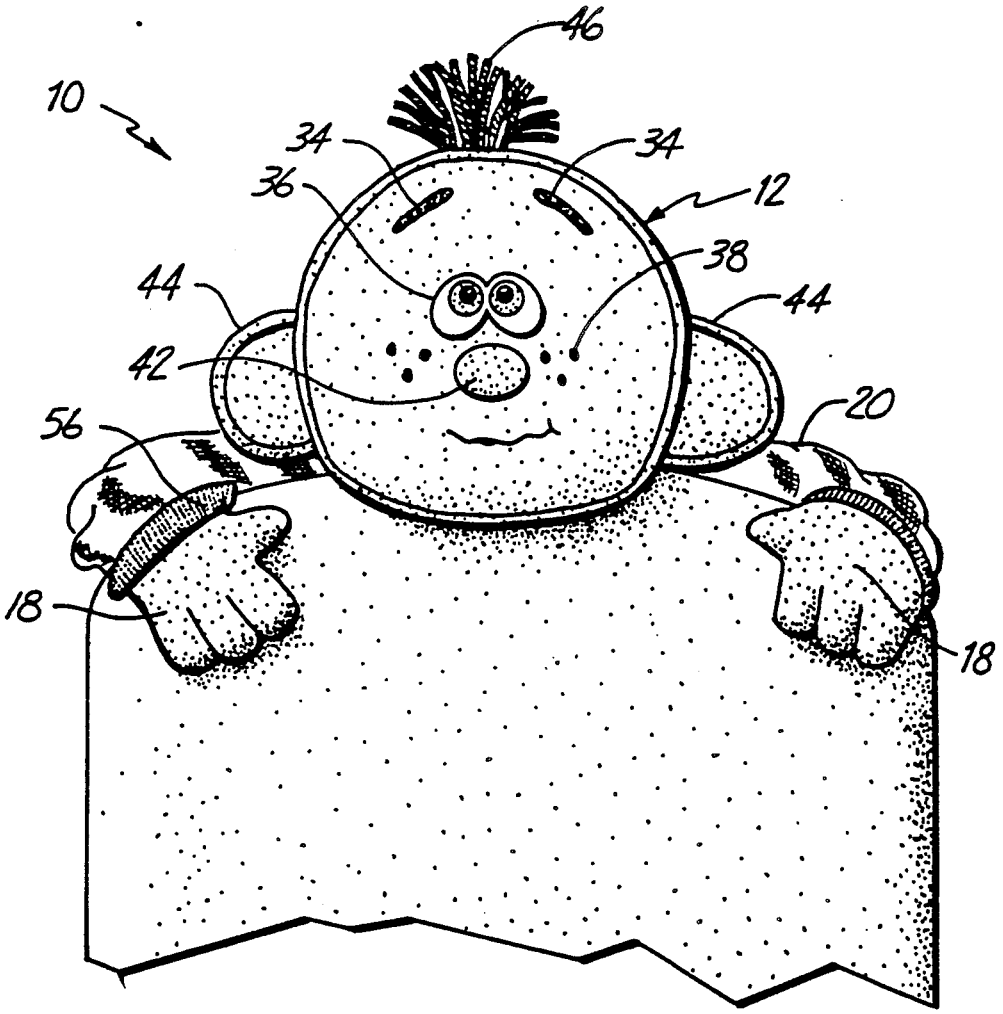
FIG. 10 shows the doll draped over the back of a chair.

Because of the unique head/body/neck connection, doll 10 can assume a number of attractive and entertaining poses. FIG. 8, 9 and 10 are examples of a sitting pose, a lying pose, and a pose in which doll 10 is draped over the back of chair 60. These are just a few of the many poses which are possible with this unique and attractive doll.

Because the doll is entirely made of fabric (except for the plastic insert in the nose) it is extremely light weight and can be carried easily by small children. Its soft, light-weight fabric construction allows it to be posed easily and with many variations. Because the head 12 is stuffed, and connection of neck 26 is along first horizontal connection line 28 which is above the center line of head 12, doll 10 will always tend to assume a pose in which the head is upright. This also allows the head to be draped over objects, as illustrated in FIG. 10.

In FIG. 11A–11M the steps of fabrication of doll 10 through the attachment of head 12 and neck 26 to inner body 14 is shown.

Figure 11A:
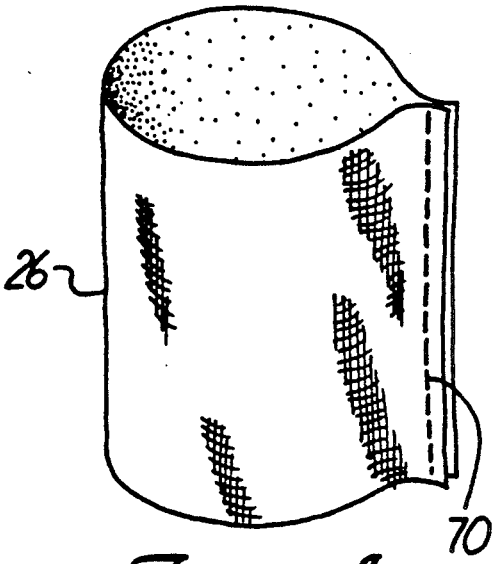

In FIG. 11A, neck 26 is formed by folding over a piece of fabric and sewing along seam 70 to form a flat tube of fabric.

Figure 11B:
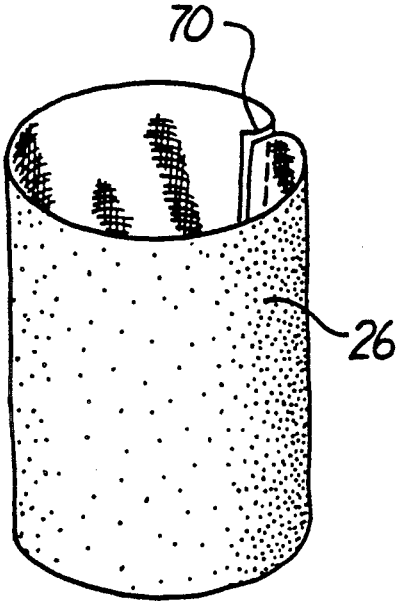

In FIG. 11B, neck 26 has been turned right side out.

Figure 11C:
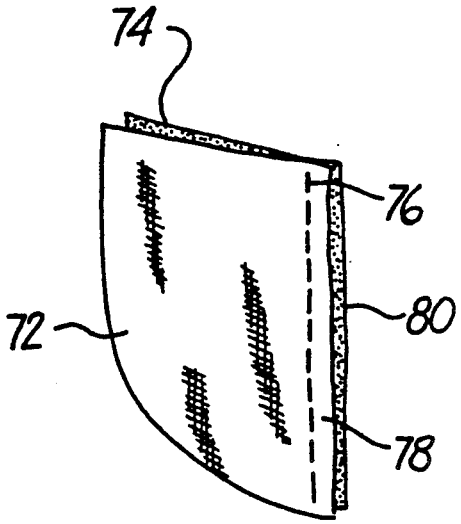

In FIG. 11C, two lower back head pieces 72 and 74 are sewn together along seams 76 and 78, with an opening 80 left to allow stuffing.

Figure 11D:
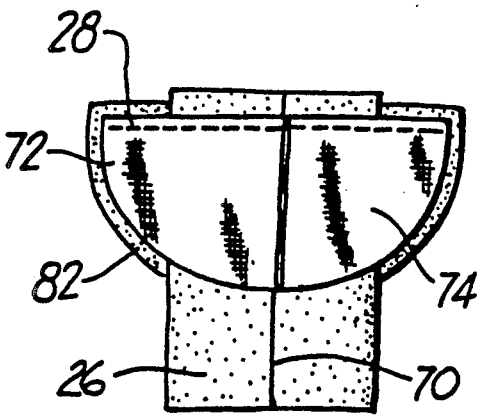

In FIG. 11D, upper back head panel 82 and the lower back head formed by panels 72 and 74 are sewn together with neck 26 placed between, along a seam which defines first connection line 28.

In FIG. 11E, ear 44 is formed by sewing together two pieces of material along seam 84.

In FIG. 11F, ear 44 has been turned inside out and top stitched along line 86.

In FIG. 11G, front 32 and the back 30 (with neck 26 attached) are sewn together along seam 88. During this process, ears 44 and hair 46 are positioned between front 32 and back 30 so that they are attached as part of the head by the stitching of seam 88. Front 32 has at this point the embroidered features such as eyebrows 34, eyes 36, freckles 38, and mouth 40 already formed. The embroidered features are facing inward, because front and back panels 30 and 32 are positioned face-to-face in FIG. 11G.

In the next step, which is illustrated in FIG. 11H, head 12 has been turned right-side out. Top stitching 90 is formed around the outer edge of head 12. Nose 42 is attached to front face panel 32.

In FIG. 11I, head 12 is being stuffed through opening 80. Once the stuffing has been completed, opening 80 is closed with hand stitching 92, as shown in FIG. 11J.

Inner body 14 is formed by sewing a single piece of fabric along seams 94 and 96 to form a container with a top opening. This is illustrated in FIG. 11K.

Figure 11M:
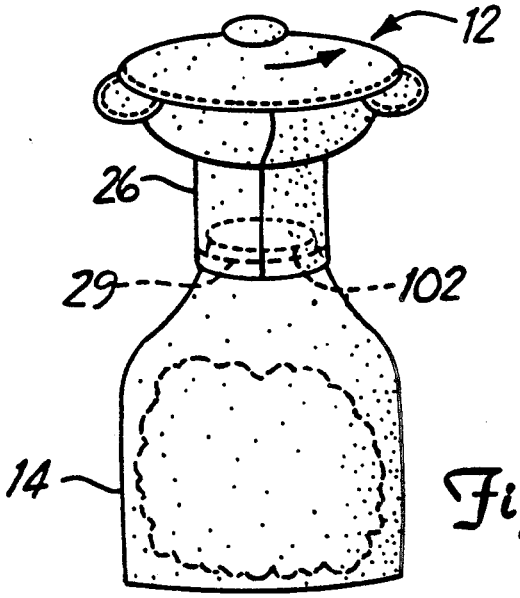
Figure 11K:
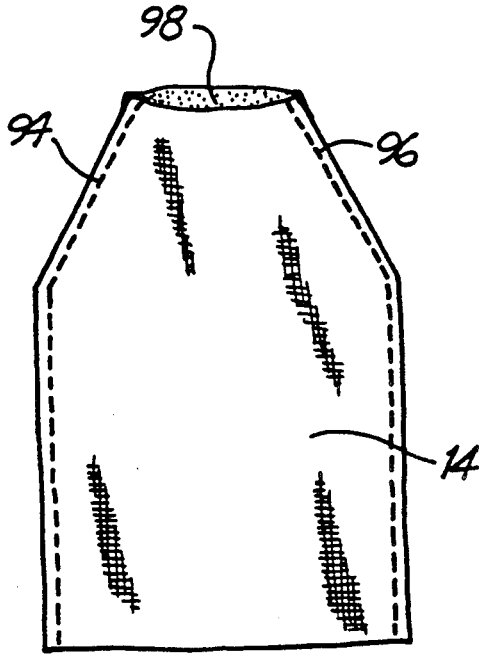
Figure 11L:
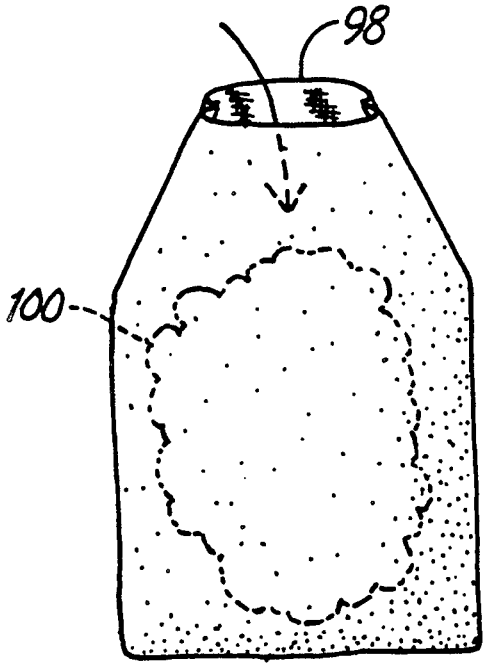

In FIG. 11L, inner body 14 is filled with stuffing 100 at the bottom end of inner body 14. No stuffing is left in the upper area which will connect to neck 26. As shown in FIG. 11L, inner body 14 has been turned inside out from the illustration in FIG. 11K.

In FIG. 11M, neck 26 is attached at it lower end to the upper area of inner body 14. Neck 26 overlaps the upper end of inner body 14, and a horizontal top stitch 102 extends through all four 15 layers, (i.e., the two layers of neck 26, and the two layers of body 14) to form second horizontal connection line 29.

The remaining assembly steps are generally as follows. Inner body 14 is inserted into outer body shirt 20 so that neck 26 is located within the collar 50 of shirt 20. Neck 26 and shirt 20 are sewn together along horizontal connection line 29. The arms 16 and hands 18 have been previously formed and attached into the arms of shirt 20. Similarly, bottom panel 22 and legs 24 are formed, sewn together, and attached to the bottom end of shirt 20.

In other embodiments of the present invention, a separate inner body is not used. Instead, the attachment of neck 26 is directly to outer body shirt 20, and the stuffing is simply placed within the outer body.

Although the present invention has been described with reference to preferred embodiments, workers skilled in the art will recognize that changes may be made in form and detail without departing from the spirit and scope of the invention.

What is claimed is:

1. A doll comprising:

a body;

a head having a front and a back connected to the front and generally opposite the front; and a flat, flexible tubular neck which is attached at an upper end to an upper central portion of the back of the head along a first horizontal connection line to form a first flexible horizontal hinge between the head and the neck, and which is attached at a lower end to an upper portion of the body.

2. The doll of claim 1 wherein the neck is attached to the body along a second horizontal connection line.

3. The doll of claim 1 wherein the body, the head, and the neck are made of fabric.

4. The doll of claim 1 wherein the first connection line is located above a horizontal center line of the back of the head.

5. The doll of claim 1 wherein the back of the head is formed of a top panel, a left bottom panel and a right bottom panel, the panels being attached to form a generally circular pattern.

6. The doll of claim 5 wherein the top panel, the left bottom panel, the right bottom panel and the neck are connected together along the first connection line.

7. The doll of claim 5 wherein the front of the head is generally circular and is attached to the back adjacent a peripheral edge of the head.

8. The doll of claim 7 wherein stuffing is positioned within the head between the front and the back.

9. The doll of claim 1 wherein the body is a sack with stuffing therein.

10. The doll of claim 9 and further comprising:

a shirt covering the body, the shirt having an opening through which the neck extends and having sleeves out of which arms extend; and a bottom attached to the shirt to enclose the body and having a pair of legs extending downward.

11. The doll of claim 10 wherein the shirt, the arms, the bottom and the legs are made of fabric.

12. A doll comprising:

a head having a generally circular fabric front and a generally circular fabric back connected to the front and generally opposite the front with stuffing between the front and the back;

a stuffed fabric body with arms and legs; and a fabric neck which connects the head and the body, the neck being connected at an upper end to an upper central portion of the back of the head along a connection line which is located above a horizontal center line of the back of the head.

13. The doll of claim 12 wherein the stuffed fabric body comprises:

a stuffed inner body connected to the neck;

a shirt covering the inner body, the shirt having an opening through which the neck extends and having sleeves out of which the arms extend; and a bottom attached to the shirt to enclose the inner body and having a pair of legs attached.

* * * * *